US011773712B2

(12) United States Patent
Rector

(10) Patent No.: US 11,773,712 B2
(45) Date of Patent: Oct. 3, 2023

(54) METHOD AND APPARATUS FOR OPTIMIZING DRILLING USING DRILL BIT GENERATED ACOUSTIC SIGNALS

(71) Applicant: James Rector, Oakland, CA (US)

(72) Inventor: James Rector, Oakland, CA (US)

( * ) Notice: Subject to any disclaimer, the term of this patent is extended or adjusted under 35 U.S.C. 154(b) by 158 days.

(21) Appl. No.: 17/479,814

(22) Filed: Sep. 20, 2021

(65) Prior Publication Data

US 2023/0086947 A1 Mar. 23, 2023

(51) Int. Cl.
*E21B 44/04* (2006.01)
*E21B 49/00* (2006.01)

(52) U.S. Cl.
CPC ..... *E21B 44/04* (2013.01); *E21B 49/006* (2013.01)

(58) Field of Classification Search
CPC ..... E21B 44/04; E21B 49/006
See application file for complete search history.

(56) References Cited

U.S. PATENT DOCUMENTS

| | | | | |
|---|---|---|---|---|
| 4,599,904 | A * | 7/1986 | Fontenot | E21B 49/006 73/152.59 |
| 5,050,130 | A | 9/1991 | Rector et al. | |
| 7,044,239 | B2 | 5/2006 | Pinckard et al. | |
| 7,140,452 | B2 | 11/2006 | Hutchinson | |
| 8,919,457 | B2 | 12/2014 | Hutchinson | |
| 10,132,162 | B2 | 11/2018 | Neale et al. | |
| 10,677,052 | B2 * | 6/2020 | Storm, Jr. | E21B 49/00 |
| 10,907,465 | B2 * | 2/2021 | Hay | E21B 44/04 |
| 11,299,975 | B2 * | 4/2022 | Harvey | E21B 7/06 |
| 11,448,576 | B2 * | 9/2022 | Li | E21B 44/04 |
| 2012/0261190 | A1 * | 10/2012 | Krueger, IV | E21B 44/04 175/24 |
| 2013/0105221 | A1 * | 5/2013 | Wassell | E21B 44/04 175/40 |
| 2015/0369030 | A1 * | 12/2015 | Hay | E21B 21/08 700/275 |
| 2016/0054729 | A1 * | 2/2016 | Payette | E21B 7/00 700/275 |

(Continued)

FOREIGN PATENT DOCUMENTS

| | | | | |
|---|---|---|---|---|
| AU | 2012328705 | A1 * | 5/2014 | E21B 44/00 |
| AU | 2013408249 | A1 * | 5/2016 | E21B 21/08 |
| CN | 110486007 | A * | 11/2019 | E21B 49/003 |

OTHER PUBLICATIONS

Poletto, et al., Drill-bit displacement-source model: Source performance and drilling parameters, Geophysics, vol. 71, No. 5 (Sep.-Oct. 2006).

*Primary Examiner* — Frederick L Lagman
(74) *Attorney, Agent, or Firm* — Richard A. Fagin

(57) ABSTRACT

A method for optimizing borehole drilling by a drill string having a drill bit at a rotated and axially urged to drill formations includes measuring a parameter related to at least axial and torsional motion of a drill string propagating as elastic waves at a selected position along the drill string. An axial force exerted by the drill bit and torque applied to the drill bit are determined from the measurements related to at least axial and torsional motion. A confined compressive strength of the formations is determined from the measurements related to at least axial and torsional motion. At least one of the determined axial force and the determined torque is adjusted such that a mechanical specific energy applied to the formation is closest in value to the confined compressive strength.

18 Claims, 2 Drawing Sheets

(56) References Cited

U.S. PATENT DOCUMENTS

| | | | | |
|---|---|---|---|---|
| 2016/0069182 | A1* | 3/2016 | Neale | G01V 1/288 175/50 |
| 2016/0305231 | A1* | 10/2016 | Majidi | E21B 44/06 |
| 2017/0067337 | A1* | 3/2017 | Havens | G01V 1/288 |
| 2020/0256187 | A1* | 8/2020 | Lakings | E21B 49/003 |
| 2020/0340351 | A1* | 10/2020 | Harvey | E21B 44/04 |

* cited by examiner

METHOD AND APPARATUS FOR OPTIMIZING DRILLING USING DRILL BIT GENERATED ACOUSTIC SIGNALS

CROSS REFERENCE TO RELATED APPLICATIONS

Not Applicable.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

This disclosure relates to the field of subterranean well drilling. More particularly, the disclosure relates to methods and apparatus for determining subsurface earthen formation properties, drilling parameters and optimum parameters for drilling using acoustic signals generated by action of a drill bit in cutting through the earthen formations.

Subterranean well drilling includes rotating a drill bit against subterranean rock formations while axially urging the drill bit against the formations in the direction the well is intended to be lengthened (deepened). It is important for a well drilling operator to have information concerning the amount of axial force (weight on bit—WOB) applied to the drill bit, the rotational speed (RPM) of the drill bit, torque applied at the drill bit (TOB) to cause its rotation and cutting action, and resulting axial rate of elongation of the well (rate of penetration—ROP) for the drilling operator to drill the well efficiently. Most well drilling systems (drilling rigs) have equipment to make surface-based (on the drilling rig) measurements of WOB, RPM, ROP, and TOB. These surface-based measurements often do not represent what the actual values are at the drill bit due to effects of motion and friction of the drill string (the entire string of drill pipe and drilling tools extending from the drilling rig to the drill bit), properties of the drilling fluid (e.g., "mud") used during the drilling process, and the mechanical condition of the drill well or "borehole." For example, at-bit TOB can differ from surface-measured TOB due to pipe friction with the borehole wall. Moreover, the measurements made at the surface are often static measurements.

Prior attempts to address the issue of differences between surface and at bit measurements of the above parameters have been made, for example, by correcting surface measurements or by making near bit measurements using sensors disposed in the drill string proximate the bit. Downhole vibration measurements of bit/rock interactions can be made using, for example, 3-component accelerometers located near the drill bit. From these vibration measurements, at- or near-bit drilling parameters have been estimated but not directly determined without the use of external information.

Perhaps the most important aspect of drilling optimization is to optimize ROP. The ROP is theoretically at its maximum when the mechanical specific energy (MSE) of the formation cutting by the drill bit is equal to the confined compressive strength (CCS) of the rock formations. The MSE is related to RPM and WOB, as well as other parameters: e.g., ROP, drill bit wear, and TOB. The equation for MSE is:

$$MSE = \text{Work/unit volume drilled} = E_b\left\{\frac{WOB \cdot ROP + 60 \cdot 2\pi \cdot RPM \cdot TOB}{A_b \cdot ROP}\right\} \quad (1)$$

where $E_b$ is the efficiency of the drill bit, and Ab is the cross-sectional area of the drill bit (see, e.g., Ariffin Samsuri, *Drilling*, University of Technology, Malaysia, ISBN: 978-1-78984-304-0, Oct. 31, 2018), 2018). When "at bit" MSE satisfies the above expression, optimal drilling conditions exist.

It is important for the drilling operator to be able to identify adverse drilling conditions such excessive drill string friction, drill bit whirl (precession of the drill bit axis opposite to bit rotation direction), excessive drill bit wear and unwanted vibrations in the drill string, and for the drilling operator to correct for such conditions as part of drilling optimization.

SUMMARY

One aspect of the present disclosure is a method for optimizing drilling of a borehole. A method for optimizing borehole drilling according to this aspect of the disclosure is by a drill string having a drill bit rotated and axially urged to drill formations. The method includes measuring a parameter related to at least axial and torsional motion of a drill string propagating as elastic waves at a selected position along the drill string. An axial force exerted by the drill bit and torque applied to the drill bit are determined from the measurements related to at least axial and torsional motion. The strength of the formation is determined from the measurements related to at least axial and torsional motion. At least one of the determined axial force and the determined torque is adjusted such that a mechanical specific energy applied to the formation is closest in value to the confined compressive strength of the formation.

In some embodiments, the determining axial force and torque comprises: computing the autocorrelations of the measured parameters; deconvolving the autocorrelated measured parameters; spectrally shaping the deconvolved, autocorrelated measured parameters; and determining at least one attribute of the spectrally shaped, deconvolved, autocorrelated measured parameters.

In some embodiments, the deconvolving comprises determining a minimum phase inverse of the measured parameters over a selected time interval and correlating the determined minimum phase inverse with the autocorrelated, measured parameters.

In some embodiments, the spectrally shaping comprises at least one of bandpass filtering and Butterworth filtering.

In some embodiments, the parameter related to at least axial and torsional motion comprises acceleration.

In some embodiments, the parameter related to at least one of axial and torsional motion comprises strain.

Some embodiments further comprise determining a rotation rate of the drill bit from the measurements related to at least axial and torsional motion.

In some embodiments, the determining rotation rate comprises determining at least a center frequency of the measurements.

Some embodiments further comprise estimating wear of the drill bit by comparing the determined rotation rate with a rotation rate of equipment used to rotate the drill string.

Some embodiments further comprise measuring a parameter related to bending motion of the drill string propagating as elastic waves along the drill string and reducing noise in the measurements related to at least axial and torsional motion caused by the bending motion.

Other aspects and possible advantages will be apparent from the following description and claims.

DETAILED DESCRIPTION

Figure 1:
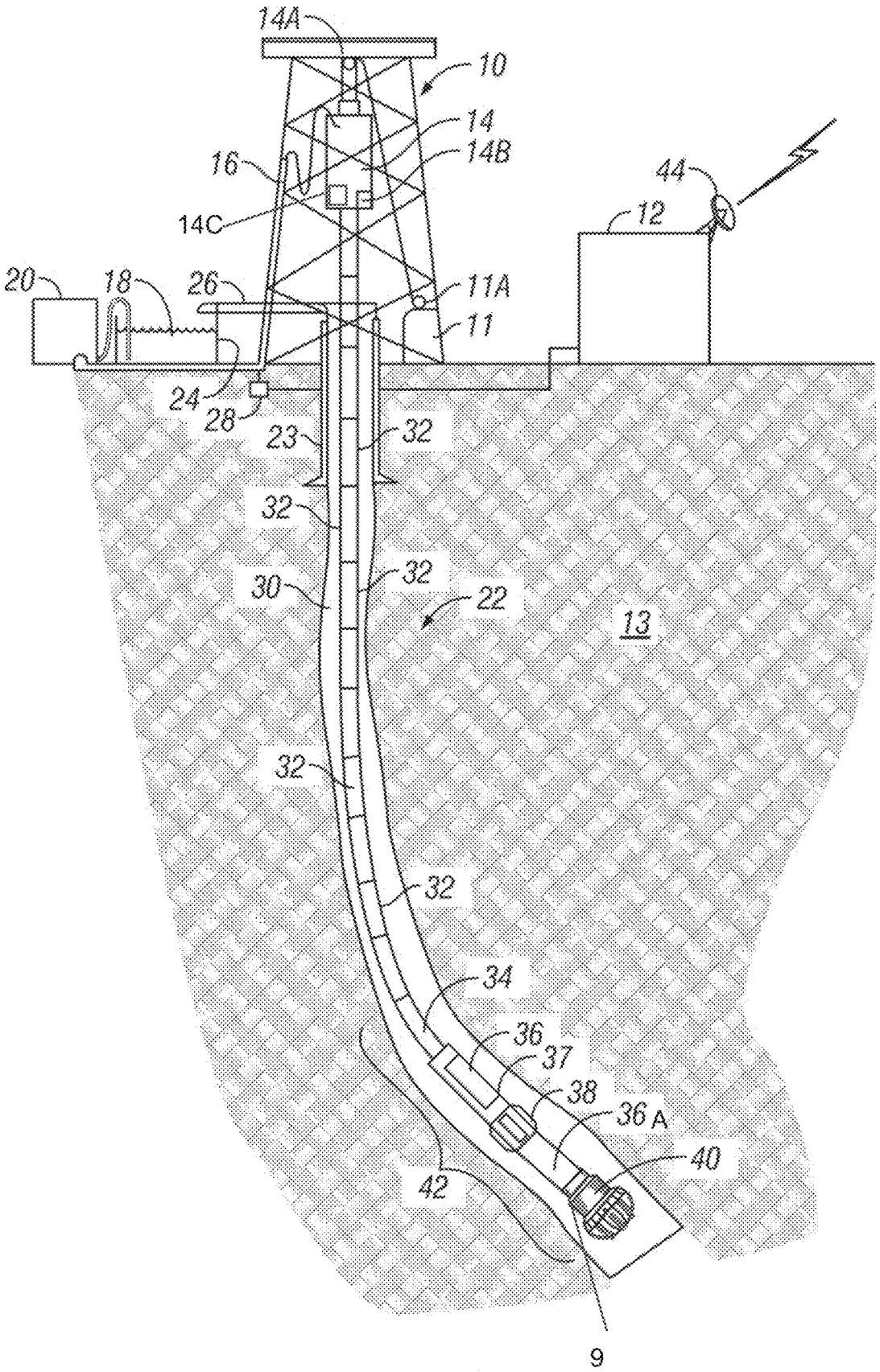
FIG. 1 shows an example embodiment of a drilling and measurement system that can implement a method according to the present disclosure.

FIG. 1 shows an example embodiment of a borehole drilling and measurement system which may be used with various embodiments of a method according to the invention. A drilling rig 10 includes a draw works 11 or similar lifting device known in the art to raise, suspend and lower a drill string. The drill string includes a number of threadedly coupled sections of drill pipe, shown generally at 32. A lowermost part of the drill string is known as a bottom hole assembly ("BHA") 42, which includes at its lowermost end in the embodiment of FIG. 1, a drill bit 40 to cut through earthen formations 13 below the earth's surface to drill a borehole 22. The BHA 42 may include various devices such as heavy weight drill pipe 34, and drill collars 36. The BHA 42 may also include one or more stabilizers 38 that include blades thereon adapted to keep the BHA 42 approximately in the center of the borehole 22 during drilling. In various embodiments of a drilling system, one or more of the drill collars 36 may include a measurement while drilling (MWD) sensor and telemetry unit (collectively "MWD system"), shown generally at 37. The sensors and purpose of the MWD system 37 and the types of sensors therein will be further explained below with reference to FIG. 2.

The draw works 11 may be operated during active drilling so as to apply a selected axial force (WOB) to the drill bit 40. Such axial force, as is known in the art, results from the weight of the drill string, a large portion of which is suspended by the draw works 11. The unsuspended portion of the weight of the drill string is at least in part transferred to the drill bit 40 as a static axial force. The bit 40 is rotated, in the present example embodiment, by turning the pipe 32 using a rotary table/kelly bushing (not shown in FIG. 1) or preferably a top drive 14 (or power swivel) of any type well known in the art. While the pipe 32 (and consequently the BHA 42 and bit 40 as well) is turned, a pump 20 lifts drilling fluid ("mud") 18 from a pit or tank 24 and moves it through a standpipe/hose assembly 16 to the top drive 14 so that the mud 18 is forced through the interior of the pipe segments 32 and then through the BHA 42. Ultimately, the mud 18 is discharged through nozzles or water courses (not shown) in the bit 40, where it lifts drill cuttings (not shown) to the earth's surface through an annular space between the wall of the borehole 22 and the exterior of the pipe 32 and the BHA 42. The mud 18 then flows up through a surface casing 23 to a wellhead and/or return line 26. After removing drill cuttings using screening devices (not shown in FIG. 1), the mud 18 is returned to the tank 24.

In some embodiments, a drill collar 36A located above the drill bit 40 may comprise an hydraulic motor used to rotate the drill bit as a result of pumping mud through the hydraulic motor. In such embodiments, the drill string may be rotated by the surface drive (top drive or kelly) in addition to motor rotation, or the motor rotation alone may turn the drill bit 40. When an hydraulic motor is used, it may be desirable to include certain sensors disposed between the motor and the drill bit 40, such sensors shown generally at 9 and to be explained further with reference to FIG. 2.

The standpipe system 16 in the present example embodiment may include a pressure transducer 28, which generates an electrical or other type of signal corresponding to the mud pressure in the standpipe system 16. The pressure transducer 28 is operatively connected to systems (not shown separately in FIG. 1) inside a recording unit 12 for decoding, recording and interpreting signals communicated from the MWD system 37. As is known in the art, the MWD system 37 may include a device, which will be explained below with reference to FIG. 2, for modulating the pressure of the mud 18 to communicate data to the earth's surface. The pressure transducer 28 can be operatively coupled to the recording unit 12 by any suitable means known in the art.

The drilling rig 10 in the present example embodiment includes a sensor, shown generally at 14A, and called a "hookload sensor", which measures a parameter related to the weight suspended by the drawworks 11 at any point in time. Such weight measurement is known in the art by the term "hookload." As is known in the art, when the drill string is coupled to the top drive 14, the amount of hookload measured by the hookload sensor 14A will include the drill string weight and the weight of the top drive 14.

The hookload sensor 14A can be operatively coupled to the recording unit 12 by any suitable means known in the art. It should be clearly understood that for purposes of defining the scope of this disclosure, "hookload" as used herein may include measurements of the weight suspended by the rig equipment. Hookload may also include measurements related to the axial loading of the drill string measured more directly, such as using an "instrumented top sub" having axial strain gauges therein. One such instrumented top sub is sold under the trade name ADAMS by Baker Hughes, Inc., Houston, Tex.

The drilling rig 10 in the present example embodiment may also include a torque and rotary speed ("RPM") sensor, shown generally at 14B. The torque and rotary speed sensor 14B measures the rotation rate of the top drive and drill string, and measures the torque applied to the drill string by the top drive 14. The torque/RPM sensor 14B can be coupled to the recording unit 12 by any suitable means known in the art.

In the present example embodiment, the top drive 14 may comprise motion sensors, shown generally at 14C that comprise sensing elements arranged to measure a motion (in particular, oscillatory motion such as vibration) related parameter of the drill string. In the present example embodiment, the sensing elements may be accelerometers or strain gauges oriented to measure a motion related parameter (e.g., acceleration or strain) in the drill string axially (along the longitudinal axis of the drill string), torsionally, such as by a sensor oriented tangentially along the drill string, and radially. The motion sensors may be arranged in particular to detect elastic waves propagating along the drill string in the form of axial waves, torsional (or tangential) waves and bending waves. Signals from the sensors 14C may be processed in a processor (not shown separately) such as a microcomputer, microprocessor, field programmable gate array or the line, or the signals may be communicated to the recording unit 12 for processing in a manner to be explained further below.

The drilling rig 10 in the present example embodiment may also include a sensor, shown generally at 11A and referred to herein as a "block height sensor" for determining the vertical position of the top drive at any point in time. The block height sensor 11A can be operatively coupled to the recording unit 12 by any suitable means known in the art.

The block height sensor 11A, hookload sensor 14A and RPM/torque sensor 14B shown in FIG. 1 are only representative examples of the locations of such sensors in a drilling rig. As will be further explained with respect to various embodiments of methods according to the invention, it is only necessary to be able to determine the amount of axial force needed to move the drill string, the amount of torque needed to move the drill string and/or its rotation rate, and the axial position and/or axial velocity of the drill string. Accordingly, the positions and particular types of sensors as shown in FIG. 1 are not intended to limit the scope of the disclosure.

In some embodiments the recording unit 12 may include a remote communication device 44 such as a satellite transceiver or radio transceiver, for communicating data received from the MWD system 37 (and other sensors at the earth's surface) to a remote location. Such remote communication devices are well known in the art. The data detection and recording elements shown in FIG. 1, including the pressure transducer 28 and recording unit 12 are only examples of data receiving and recording systems which may be used with the invention, and accordingly, are not intended to limit the scope of the invention.

Figure 2:
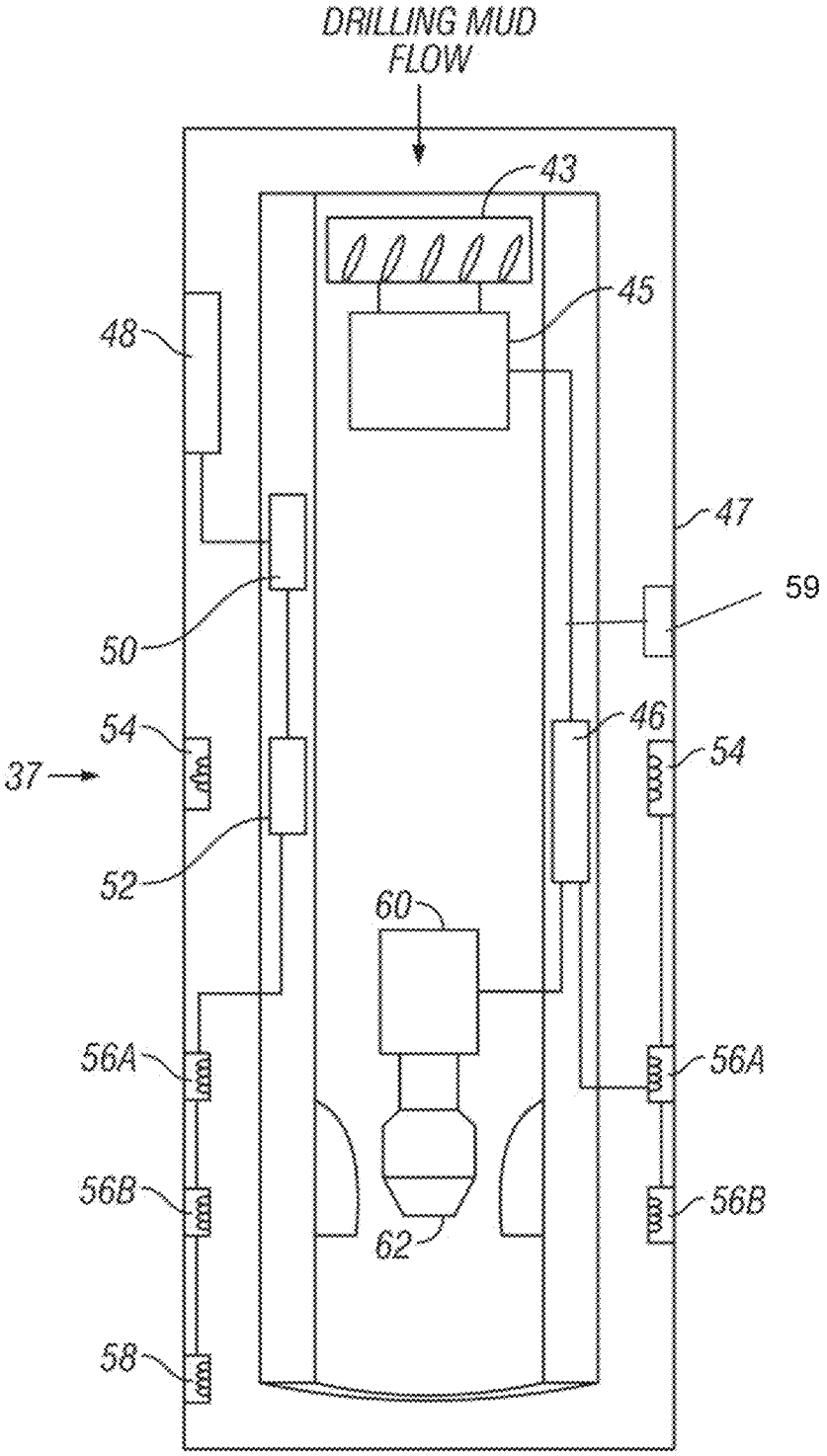
FIG. 2 shows an example embodiment of a measurement while drilling (MWD) system.

One embodiment of an MWD system, such as shown generally at 37 in FIG. 1, is shown in more detail in FIG. 2. The MWD system 37 is typically disposed inside a non-magnetic housing 47 made from monel or the like and adapted to be coupled at its axial ends within the drill string. The housing 47 may be configured to behave mechanically in a manner similar to other drill collars (36 in FIG. 1). The housing 47 may include disposed therein a turbine 43 which converts some of the flow of mud (18 in FIG. 1) into rotational energy to drive an alternator 45 or generator to power various electrical circuits and sensors in the MWD system 37. Other types of MWD systems may include batteries as an electrical power source.

Control over the various functions of the MWD system 37 may be performed by a central processor 46. The processor 46 may also include circuits for recording and processing signals generated by the various sensors in the MWD system 37 as will be explained further below. In the present example embodiment, the MWD system 37 includes a motion sensor assembly 50, having therein triaxial motion responsive sensors, e.g., accelerometers or strain gauges such that vibrations along the drill string in axial, torsional and radial directions can be determined. The MWD system 37 may also include a gamma ray detector 48 and separate rotational (angular)/axial accelerometers, magnetometers, pressure transducers or strain gauges, shown generally at 58. The MWD system 37 may also include a resistivity sensor system, including an induction signal generator/receiver 52, and transmitter antenna 54 and receiver 56A, 56B antennas. The resistivity sensor can be of any type well known in the art for measuring electrical conductivity or resistivity of the formations (13 in FIG. 1) surrounding the borehole (22 in FIG. 1). In some embodiments, the MWD system includes a pressure sensor 49 configured to measure fluid pressure inside the drill string and/or in an annular space between the wall of the wellbore and the outside of the drill string at a position proximate the bottom of the drill string.

The MWD system 37 may also comprise a "short hop" electromagnetic transceiver of types known in the art, in particular although not limited to use when near bit sensors such as shown at 9 in FIG. 1 are used to ensure vibration measurement proximate the drill bit (40 in FIG. 1) when an hydraulic motor is used. A transceiver antenna 59 may communicate signals between the near-bit sensors (9 in FIG. 1) and the processor 46.

The processor 46 periodically interrogates each of the foregoing and other sensors in the MWD system 37 and may store the interrogated signals from each sensor in a memory or other storage device associated with the processor 46. Some of the sensor signals may be formatted for transmission to the earth's surface in a mud pressure modulation telemetry scheme. In the embodiment of FIG. 2, the mud pressure may be modulated by operating an hydraulic cylinder 60 to extend a pulser valve 62 to create a restriction to the flow of mud through the housing 47. The restriction in mud flow increases the mud pressure, which is detected by transducer (28 in FIG. 11). Operation of the cylinder 60 is typically controlled by the processor 46 such that the selected data to be communicated to the earth's surface are encoded in a series of pressure pulses detected by the transducer (28 in FIG. 1) at the surface. Many different data encoding schemes using a mud pressure modulator such as shown in FIG. 2 are well known in the art. Accordingly, the type of telemetry encoding is not intended to limit the scope of the invention. Other mud pressure modulation techniques which may also be used with the invention include so-called "negative pulse" telemetry, wherein a valve is operated to momentarily vent some of the mud from within the MWD system to the annular space between the housing and the wellbore. Such venting momentarily decreases pressure in the standpipe (16 in FIG. 1). Other mud pressure telemetry includes a so-called "mud siren", in which a rotary valve disposed in the MWD housing 47 creates standing pressure waves in the mud, which may be modulated using such techniques as phase shift keying for detection at the earth's surface.

In some embodiments, the measurements made by the various sensors in the MWD system 37 may be communicated to the earth's surface substantially in real time, and without the need to have drilling mud flow inside the drill string, by using an electromagnetic communication system coupled to a communication channel in the drill pipe segments themselves. One such communication channel is disclosed in Published U.S. Patent Application No. 2002/0075114 A1 filed by Hall et al. The drill pipe disclosed in the Hall et al. application includes electromagnetically coupled wires in each drill pipe segment and a number of signal repeaters located at selected positions along the drill string. Alternatively fiber-optic or hybrid data telemetry systems might be used as a communication link from the downhole processor 46 to the earth's surface. Other embodiments of "wired" drill pipe for near real time telemetry and electric power supply to the MWD system are described, for example, in U.S. Patent Application Publication No. 2019/0119990 filed by Fredriksen et al.

In some embodiments, each component of the BHA (42 in FIG. 1) may include its own rotational and axial accelerometer, magnetometer, pressure transducer or strain gauge sensor. For example, referring back to FIG. 1, each of the drill collars 36, the stabilizer 38 and the bit 40 may include such sensors. The sensors in each BHA component may be electrically coupled, or may be coupled by a linking device such as a short-hop electromagnetic transceiver of types well known in the art, to the processor (46 in FIG. 2). The processor 46 may then periodically interrogate each of the sensors disposed in the various components of the BHA 42 to make motion mode determinations according to various embodiments according to the present disclosure.

For purposes of the present disclosure, and once again referring to FIG. 2, strain gauges, accelerometers or any other motion related sensor may be used to make measurements related to the acceleration imparted to the particular component of the BHA and in the particular direction described. As is known in the art, torque, for example, is a vector product of moment of inertia and angular acceleration. As is known in the art, magnetometers, for example, can be used to determine angular position from which angular acceleration can be determined. A strain gauge arranged to measure torsional strain on the particular BHA component would therefore measure a quantity directly related to the angular acceleration applied to that BHA component. Accelerometers and magnetometers have the advantage of being easier to mount inside the various components of the BHA, because their response does not depend on accurate transmission of deformation of the BHA component to the accelerometer, as is required with strain gauges. However, it should be clearly understood that for purposes of defining the scope of this invention, it is only necessary that the property measured be related to the component acceleration being described. An accelerometer adapted to measure rotational (angular acceleration) would preferably be mounted such that its sensitive direction is perpendicular to the axis of the BHA component and parallel to a tangent to the outer surface of the BHA component. The directional sensor 50, if appropriately mounted inside the housing 47, may thus have one component of its three orthogonal components which is suitable to measure angular acceleration of the MWD system 37.

In some embodiments, the as-measured (raw) acceleration or other signals are transmitted to a signal processor, e.g., on a circuit board. The sensor package may be located within a sub (selected length of thick-walled pipe having internal, sealed spaces for sensors and processing circuitry) disposed at a selected place along the drill string, and the signal processor may be a digital signal processing (DSP) integrated circuit or chip.

In some embodiments the signal processing actions performed in the signal processor are as follows.

Computing autocorrelations of the raw sensor signals over a prescribed acquisition time interval as described in the Rector et al. '130 patent;

Deconvolution as described in the '130 patent;

Application of a spectral shaping filter to the deconvolved signals, resulting in processed signals;

Calculation of signal attributes; and

Calculation of drilling parameters at or near the drill bit

Computing an autocorrelation of acceleration or other motion-related signals over a predetermined time interval may be performed, for example, as described in U.S. Pat. No. 5,050,130 issued to Rector et al. The autocorrelation of the signal may be computed as the Inverse Discrete Fourier Transform (IDFT) of the product between the signal's Discrete Fourier Transform (DFT) and its complex conjugate. In practice the autocorrelation can be truncated to encompass only certain time lags.

Deconvolution

As described in the '130 patent, the deconvolution operation consists of obtaining the minimum phase inverse of the signal over a selected number of points (time samples) and correlating it with the computed autocorrelation resulting in a deconvolved autocorrelation signal. The deconvolution operator can also be applied to the raw signal prior to autocorrelation.

Application of a Spectral Shaping Filter

Arrivals of interest in the deconvolved autocorrelation signal are axial and torsional waves travelling in the drill string that originate from the drill bit interaction with the formation being drilled. The axial and torsional waves create accelerations that are detected primarily by the axial and torsional accelerometers or other motion-related sensors in the sensor package. The radial accelerometer in the sensor package detects primarily bending waves, which are considered to be noise to be minimized during the signal processing. Noise-resulting signals such as pipe slapping and rig machinery noise can corrupt the desired drill bit/formation interaction signals. Each type of wave (axial, torsional and bending) has an optimal spectrum, and by applying a spectral shaping filter to the deconvolved autocorrelation signals enhances desired frequencies relative to undesired frequencies in the autocorrelation signals, resulting in processed signals. As is also described in the '130 patent, the processed signals represent the filtered response of the drill string system including the effects of the initial bit interaction with the rock and the propagation along the drillstring to the sensor location(s). The spectral shaping filter can be in the form of, for example, a simple bandpass filter such as a Butterworth filter prescribed over the optimal frequency range of each type of signal, or more complex filters obtained either from the signals themselves or by simulations of drill string wave propagation to determine the optimal spectrum.

Calculation of Attributes

In one embodiment, selected attributes are calculated from each of the processed signals as described above. These attributes can include peak, trough, and zero crossing times relative to the zero-lag time of the autocorrelation function, interpolated to a desired timing precision, along with peak and trough amplitudes interpolated to a selected amplitude precision. The attributes may be computed over specified time intervals that encompass desired arrival times, such as primary and selected multiple arrival times (as represented in the processed signals). It will be understood by one of ordinary skill in the art, that there are many other attributes that can be used to represent time delay and signal amplitude, and in some embodiments, the entire wavelet can also be used.

In one embodiment, the time delay, $t_a$, of the processed axial signal primary wavelet peak, relative to the zero-lag time of the autocorrelation function, is approximately related to formation compressional modulus, $M_c$, using equations (6), (7), (8), and (16) as set forth in Poletto, et al., *Drill-bit displacement-source model: Source performance and drilling parameters*, Geophysics, vol. 71, no. 5 (September-October 2006). Likewise, the time delay, $t_t$, of the processed tangential signal primary wavelet peak is approximately related to formation shear modulus, $M_s$, also using equations (6), (7), (8), and (16) in Poletto, et al (2006).

Using $t_a$ as defined at 47 along with, $A_a$, the square root of the axial wavelet peak amplitude, the WOB determined at the drill bit and ROP at the drill bit can be calculated using equation (6), (7), (8), and (16) in Poletto, et al, 2006).

Downhole TOB can be calculated using $t_t$, along with, $A_t$, the square root of the tangential wavelet peak amplitude, by a small modification to equations (6), (7), (8), and (16) in Poletto, et al, 2006. In particular, because the axial force is a monopole and the tangential force is a dipole, co in equations (6), (7), (8), and (16) in Poletto, et al. 2006 may be replaced by $\omega^2$/RPM/D, where D represents the diameter of the drill bit and $\omega$ is angular frequency.

In one embodiment, wavelets representing different moduli and drilling parameters may be simulated, e.g., in the frequency domain, in accordance with the equations from Poletto et al. referenced above. Typically, selected multiple drill string arrivals resulting from drilling tool component diameter changes within the drill string are modeled in addition to the primary wavelet and summed with the primary wavelet. Typically these selected multiples are "short period", occurring within 1-2 periods of the primary wavelet peak arrival time The peak arrival time of the "primary plus short-period multiples" wavelet is estimated as $t_a$ (axial signal) and $t_s$ (tangential signal). The peak amplitude of the "primary plus short-period multiples" wavelet may be estimated as $A_a$ (for the axial signal) and $A_t$ (for the tangential signal). It will be understood by one of ordinary skill in the art that the wavelet modeling can be performed by adding together individual arrivals convolved with a wavelet or using full-wave modeling such as a transfer matrix, finite-difference, or finite-element methods.

In one embodiment, the attributes from the summed, modeled wavelet are compared to the attributes estimated from the proceed signals, and the drilling parameters and rock properties that minimize the differences are obtained. These values can be obtained through a parameter lookup table or an inversion methodology. One skilled in the art will appreciate that in many cases absolute values of the attributes are not needed but rather changes in drilling parameters with depth provide adequate information.

In one embodiment, drill bit RPM may be calculated by determining the center frequency of the processed axial and torsional measurements. Using the processed measurements for determining the center frequency can be performed by computing the amplitude spectrum of the processed measurements and estimating the peak frequency within a frequency range encompassing one or more selected harmonics of the fundamental rotation rate of the drill bit. In one embodiment, the fundamental rotation rate may be obtained from sensors on the drilling rig or in the drill string. The peak amplitude frequency within a range encompassing each of the selected harmonic(s) is determined. The peak frequencies are divided by their respective harmonic number and averaged to obtain an average quasi-instantaneous at-bit RPM. As an example, assume that the surface measurement of RPM obtained from a drill string driving motor (such as a top drive) is 60 RPM (equivalent to 1 Hz). If drilling with a roller cone drill bit, a large amplitude signal may be observed at the third, sixth and ninth harmonics. By measuring the frequency corresponding to the maximum spectral amplitude in a frequency window length L, (where L~0.1*harmonic frequency) around each of the foregoing $3^{rd}$, $6^{th}$ and $9^{th}$ harmonics, one obtains measured harmonic frequency values. Dividing by 3, 6, and 9, respectively, and summing the result obtains the at-bit RPM determined from drill bit vibrations. Typically, both axial and tangential signals are observed from roller cone drill bits and either can be used to determine RPM in this manner. Mostly tangential signals are observed on fixed cutter (e.g., PDC cutter) drill bits and this component is usually preferred for the measurement of RPM when drilling using fixed cutter bits.

In some situations, particularly when drilling highly inclined or horizontal boreholes, a fluid driven drilling motor (mud motor) may be used to rotate a short section of the drill string beginning at a location above the drill bit. The drill string above the drilling motor, extending to the surface, may be rotated by the drilling rig (typically from a surface drive) or may remain rotationally fixed. In such situations, it is preferable to attach the sensor package below the drilling motor to obtain good coupling between the sensors and the generated bit/rock interaction signals.

Besides calculating MSE, there are others uses for determined downhole RPM. The difference between determined downhole RPM and RPM obtained either at the surface from other devices on the drilling rig or from the drilling motor can be used as a measure of tooth or cutter wear over the life of the drill bit. It has been demonstrated in the laboratory that over the life of the drill bit, the center frequency relative to the surface RPM increases as the bit wears.

The detection of anomalous drilling modes such as excessive drill pipe bending, drill bit whirl, drill bit bounce, or drill bit balling is of value in drilling optimization. Such anomalous drilling modes can damage the drill bit, drill string or other components of the drilling system, and are typically observed when the drilling parameters are out of prescribed ranges or when downhole conditions promote their generation. Such anomalous drilling modes can often be identified based on characteristics of the processed signal such as anomalous amplitudes, frequencies, polarizations, resonances, or particular depths of initiation or cessation. Examples include bending modes (primarily on the radial component), bit whirl (primarily on the torsional component) and bit bounce (primarily on the axial component). Bit balling will change the spectrum, with frequencies related to the rotational motion of the cutters/teeth less present in the spectra.

It will be understood by those of ordinary skill in the art that there may be situations where either the axial vibration signal or the tangential vibration signal is affected by low signal-to-noise ratio, due to low signal levels (such as axial energy when drilling with fixed cutter bits or in certain formations) or high noise levels (such as bit whirl or large bending strain) or both. Moreover, some information, such as spectral measurements from the first use of the drill bit, or calibration with measured bit tooth/cutter length changes, may not be available. In these circumstances, other estimates of some values may be substituted, or only changes in values obtained.

Drilling Optimization

Ignoring drilling fluid effects and multiple sources of drill bit rotation (e.g., drilling motor and surface rotation combined), Eq. 1 as recited in the Background section herein can be used to optimize drilling penetration rate (ROP) using values of TOB, WOB, ROP, and CCS derived from determined value of $t_a$, $t_t$, $A_a$, and $A_t$, and drill bit and drill bit tooth/cutter dimensions. RPM can be obtained from either surface measurements or downhole spectral signal estimates as explained above, and drill bit efficiency can be obtained from calibrated changes in the center frequency of the drill bit fundamental frequency.

In one embodiment, WOB and RPM may be adjusted by the drilling operator using computed MSE (Eq. 1) obtained from the drilling parameters obtained above as starting values and using the CCS as the objective value as explained in Samsuri, 2018. For example, if MSE is greater than CCS, RPM can be decreased while WOB can maintained constant. It should be noted that the drilling parameters are interrelated. In other words, a decrease in RPM may cause an increase in downhole TOB and/or WOB, which may make the drilling even less efficient. Experimentation or experience with drilling in analogous conditions can aid in the optimization process. Machine learning such as neural network algorithms can be used to rapidly adjust parameters using training data from prior drilling to optimize MSE. The adjustments can also be performed gradually over a desired time interval.

In light of the principles and example embodiments described and illustrated herein, it will be recognized that the example embodiments can be modified in arrangement and detail without departing from such principles. The foregoing discussion has focused on specific embodiments, but other configurations are also contemplated. In particular, even though expressions such as in "an embodiment," or the like are used herein, these phrases are meant to generally reference embodiment possibilities, and are not intended to limit the disclosure to particular embodiment configurations. As used herein, these terms may reference the same or different embodiments that are combinable into other embodiments. As a rule, any embodiment referenced herein is freely combinable with any one or more of the other embodiments referenced herein, and any number of features of different embodiments are combinable with one another, unless indicated otherwise. Although only a few examples have been described in detail above, those skilled in the art will readily appreciate that many modifications are possible within the scope of the described examples. Accordingly, all such modifications are intended to be included within the scope of this disclosure as defined in the following claims.

What is claimed is:

1. A method for optimizing borehole drilling by a drill string having a drill bit at a longitudinal end thereof rotated and axially urged to drill formations, the method comprising:

measuring a parameter related to at least axial motion and torsional motion of the drill string at a selected position along the drill string, the parameter related to at least axial motion and torsional motion detected as elastic waves propagating along the drill string;

determining an axial force exerted by the drill bit and determining torque applied to the drill bit from the measurements related to at least axial motion and torsional motion;

estimating a confined compressive strength of the formations from the measurements related to at least axial motion and torsional motion; and adjusting at least one of the determined axial force and the determined torque by adjusting at least one of a weight on the drill bit or a rotational speed of the drill bit such that a mechanical specific energy applied to the formation is closest in value to the estimated confined compressive strength, wherein the determining axial force and torque comprises, autocorrelating the measured parameters, deconvolving the autocorrelated measured parameters, spectrally shaping the deconvolved, autocorrelated measured parameters, and determining at least one attribute of the spectrally shaped, deconvolved, autocorrelated measured parameters.

2. The method of claim 1 wherein the deconvolving comprises determining a minimum phase inverse of the measured parameters over a selected time interval and correlating the determined minimum phase inverse with the autocorrelated, measured parameters.

3. The method of claim 1 wherein the spectrally shaping comprises bandpass filtering.

4. The method of claim 1 wherein the parameter related to at least axial and torsional motion comprises acceleration.

5. The method of claim 1 wherein the parameter related to at least one of axial and torsional motion comprises strain.

6. The method of claim 1 further comprising determining a rotation rate of the drill bit from the measurements related to at least axial and torsional motion.

7. The method of claim 6 wherein the determining rotation rate comprises determining at least a center frequency of the measurements.

8. The method of claim 6 further comprising estimating wear of the drill bit by comparing the determined rotation rate with a rotation rate of equipment used to rotate the drill string.

9. The method of claim 1 further comprising measuring a parameter related to bending motion of the drill string propagating as elastic waves along the drill string and reducing noise in the measurements related to at least axial and torsional motion caused by the bending motion.

10. A method for optimizing drilling parameters used to operate a drill string having a drill bit at a longitudinal end thereof rotated and axially urged to drill formations, the method comprising:

measuring a parameter related to at least axial motion and torsional motion of the drill string at a selected position along the drill string, the parameter related to at least axial motion and torsional motion detected as elastic waves propagating along the drill string;

measuring a parameter related to bending motion of the drill string propagating along the drill string as elastic waves and using the measured parameter related to bending motion to reducing bending motion-induced noise in the measurements related to at least axial motion and torsional motion;

determining an axial force exerted by the drill bit and determining torque applied to the drill bit from the reduced noise measurements related to at least axial motion and torsional motion;

estimating a confined compressive strength of the formations from the noise-reduced measurements related to at least axial motion and torsional motion; and adjusting at least one of the determined axial force and the determined torque by adjusting at least one of a weight on the drill bit and a rotational speed of the drill bit such that a mechanical specific energy applied to the formation is closest in value to the estimated confined compressive strength.

11. The method of claim 10 wherein the determining axial force and torque comprises:

autocorrelating the measured parameters;

deconvolving the autocorrelated measured parameters;

spectrally shaping the deconvolved, autocorrelated measured parameters; and determining at least one attribute of the spectrally shaped, deconvolved, autocorrelated measured parameters.

12. The method of claim 11 wherein the deconvolving comprises determining a minimum phase inverse of the measured parameters over a selected time interval and correlating the determined minimum phase inverse with the autocorrelated, measured parameters.

13. The method of claim 11 wherein the spectrally shaping comprises bandpass filtering.

14. The method of claim 10 wherein the parameter related to at least axial and torsional motion comprises acceleration.

15. The method of claim 10 wherein the parameter related to at least one of axial and torsional motion comprises strain.

16. The method of claim 10 further comprising determining a rotation rate of the drill bit from the measurements related to at least axial and torsional motion.

17. The method of claim 16 wherein the determining rotation rate comprises determining at least a center frequency of the measurements.

18. The method of claim 16 further comprising estimating wear of the drill bit by comparing the determined rotation rate with a rotation rate of equipment used to rotate the drill string.

* * * * *